US005195874A

United States Patent [19]

Odagiri

[11] Patent Number: 5,195,874

[45] Date of Patent: Mar. 23, 1993

[54] MULTISTAGE COMPRESSOR

[75] Inventor: Akiharu Odagiri, Kanagawa, Japan

[73] Assignee: Tokico Ltd., Kanagawa, Japan

[21] Appl. No.: 712,711

[22] Filed: Jun. 10, 1991

[30] Foreign Application Priority Data

Jun. 19, 1990 [JP] Japan ..... 2-160395

[51] Int. Cl.[5] ..... F04B 23/06; F04B 49/08

[52] U.S. Cl. ..... 417/27; 137/204; 417/243

[58] Field of Search ..... 417/26, 27, 28, 12, 417/243; 137/204

[56] References Cited

U.S. PATENT DOCUMENTS 2,505,663 4/1950 Churchman ..... 417/28
4,453,893 6/1984 Hutmaker ..... 417/279

FOREIGN PATENT DOCUMENTS 949426 6/1974 Canada ..... 137/204
100056 10/1972 Fed. Rep. of Germany .
315986 9/1956 Switzerland .
272382 6/1927 United Kingdom ..... 417/27

*Primary Examiner*—Leonard E. Smith
*Attorney, Agent, or Firm*—Wenderoth, Lind & Ponack

[57] ABSTRACT

A multistage compressor includes a lower pressure side compression part, a higher pressure side compression part, an intermediate conduit placing the lower and higher side compression parts in communication, and a cooler disposed midway of the intermediate conduit for allowing gas to flow from the lower pressure side compression part to the higher pressure side compression part and for cooling the flowing gas. The cooler includes a drain outlet port. The compressor further includes an electromagnetic valve disposed at the drain outlet port and a controller for controlling the valve. The valve is opened when the compressor is started or re-started after a pause, is kept open during a predetermined period of time, and is then closed.

4 Claims, 6 Drawing Sheets

MULTISTAGE COMPRESSOR

BACKGROUND OF THE INVENTION

1. Field of the Invention

The present invention relates to a compressor for obtaining high pressure compressed gas, and particularly relates to a multistage compressor.

2. Prior Art

Conventionally, compressed gas has been used as a power source for operating various machines, and there has recently arisen a pronounced desire for more and more highly pressurized gas. In order to meet with this desire, multistage compressors have conventionally been employed in many cases.

One example of such multistage compressors is shown in FIG. 1.

The multistage compressor shown in the figure is for supplying compressed air. The compressor comprises a compressor body including: a lower pressure compression part 3 or first cylinder receiving a reciprocating piston 1 therein, and a higher pressure compression part 4 or second cylinder receiving a reciprocating piston 2 therein, and an intermediate conduit 5 connecting lower and higher pressure compression parts 3 and 4, respectively, with each other. The compressor further comprises a manually operable lower pressure side unloader or first unloader apparatus (not shown) associated with the lower pressure compression part 3 for keeping the inlet valve 6 of the lower pressure compression part 3 opened when the first unloader is actuated, a tank 7 connected with the higher pressure compression part, and a higher pressure side unloader apparatus (not shown) associated with the higher pressure compression part 4.

In the multistage compressor mentioned above, air is compressed to an intermediate pressure in the lower pressure compression part 3, and the air compressed to the intermediate pressure is transferred through the intermediate conduit 5 to the higher pressure compression part 4 where the gas is compressed to a higher pressure. The resultant high pressure compressed gas is transferred to and temporarily stored in the tank 7 and is then supplied to compressed gas-actuated machines to actuate them.

In the multistage compressor mentioned above, when the compressor is started or re-started after a long pause, aqueous vapor contained in the air can condense into waterdrops in the intermediate conduit 5 due to the difference of temperature existing between the intermediate conduit 5 and the compressed gas introduced into the conduit 5. The resultant waterdrops can enter the crankcase of the compressor, where the water mixes with lubricant in the crankcase to cause the lubricant to be emulsified.

Supposing that air in a high temperature and high humidity condition of, for example, 30° C. and 90% humidity, is sucked into the lower pressure compression portion 3 of the compressor shown in FIG. 1, and that the pressure of the gas in the intermediate conduit 5 is 2.5 kg f/cm$^2$, the dew point will be 52° C. In this case, when starting or re-starting after a long pause of between thirty minutes and over one hour, which can occur during an extreme intermittent operation of the compressor due to a small amount of compressed air being consumed, the temperature of the intermediate conduit 5 has been lowered below 52° C. When compressed air touches the intermediate conduit 5 of such lowered temperature, drainage is created. The drainage can flow into the crankcase, in which the drainage can mix with lubricant therein to emulsify it.

In order to deal with this problem, the following steps of operation have conventionally been taken in the multistage compressor mentioned above. Prior to the starting or re-starting of the compressor after a long pause, the lower pressure side unloader apparatus is manually operated to bring the lower pressure side compression part 3 into the non-compressing condition. Only the higher pressure side compression part 4 is actuated to compress gas, for a while, and then, after the compressor body is warmed up to a certain extent, the lower pressure side unloader apparatus is stopped, so that the lower and higher pressure compression parts 3 and 4, respectively, are both actuated to compress, thereby preventing the lubricant in the crankcase from being emulsified.

As explained above, in the multistage compressor shown in FIG. 1, the lower pressure side unloader apparatus is actuated so that compression of air is only effected by the lower pressure side compression part 3, in order to prevent emulsification of the lubricant in the crankcase. As a result, the volume of air to be compressed is about one fourth of that in the case in which the lower and higher pressure side compression parts 3, 4 are both actuated to compress air, thereby lowering operation efficiency.

In order to solve the problem mentioned above, an arrangement as shown in FIG. 2 has been proposed. The arrangement comprises a cooler 8 disposed midway of the intermediate conduit 5 for cooling compressed gas flowing from the lower pressure side compression part 3 to the higher pressure side compression part 4. The cooler 8 includes a cooling body 9 which cools gas by causing heat to radiate from the gas, or by using a refrigerant and a drain separation chamber 10 disposed downstream of the cooling body 9.

An obstacle plate 11 is disposed in the drain separation chamber 10 opposite the cooling body 9. The drain separation chamber 10 is further provided with an outlet port 12 for discharging the drainage. At the drain outlet port 12 is disposed a release valve 15 including a valve body 13 and a spring 14 for normally biasing the body 13 to open the valve 15 and adapted to be compressed to close the valve 15 when pressure in the intermediate conduit 5 reaches a predetermined value which is substantially equal to the intermediate pressure of the multistage compressor.

In the multistage compressor provided with the arrangement mentioned above, air which has been compressed in the lower pressure side compression part 3 is cooled by means of the cooling body 9 to intentionally create drainage. The resultant drainage is in turn blown onto the obstacle plate to be separated from the air and directed to the bottom of the drain separation chamber 10 where the drainage is discharged from the chamber 10 through the release valve 15, thereby preventing condensed waterdrops from entering the crankcase and emulsifying the lubricant therein.

The multistage compressor provided with the above-mentioned arrangement for discharging drainage, however, suffers from the following problems.

In the multistage compressor mentioned above, the pressure in the intermediate conduit 5 reaches the aforementioned predetermined value, which is set near the intermediate pressure of the compressor, just immediately after the compressor is started so that the release valve 15 is closed before the temperature of the intermediate conduit rises over the dew point. Thus, the valve 15 is only opened during a very short period of time, allowing only a very small amount of water to discharge as drainage and waterdrops which are created during the period of time from the closing of the release valve 15 to the rising of the temperature of the intermediate conduit 5 over the dew point in the drain separation chamber 10. The accumulated water or drainage may possibly evaporate again during the following compressing operation of the compressor, thereby obstructing reliable prevention of emulsification of the lubricant in the crankcase.

SUMMARY OF THE INVENTION

In view of the foregoing, it is the main object of the present invention to provide a multistage compressor in which emulsification of lubricant can reliably be prevented.

To achieve the object, the present invention provides a multistage compressor comprising a lower pressure side compression part, a higher pressure side compression part, an intermediate conduit placing the lower and higher pressure side compression parts communicating cooler disposed midway of the intermediate conduit means for allowing gas to flow therethrough from the lower pressure side compression part to the higher pressure side compression part and for cooling gas flowing therethrough, the cooling means including a drain outlet port, valve means disposed at the drain outlet port, and control means for controlling the valve means such that the valve means is opened when the compressor is started or re-started after a pause, is kept open during a predetermined period of time and is then closed.

When the compressor is started or re-started after a pause, the gas compressed in the lower pressure side compression part is cooled by means of the cooling body so that aqueous vapor contained in the compressed gas condenses to waterdrops or drainage. The valve means is kept open during a period of time after the starting or re-starting of the compressor so that drainage is discharged out through the valve means to the outside the compressor. Thus, no drainage is left in the drain separation chamber.

Many other features, advantages and additional objects of the present invention will become manifest to those versed in the art upon making reference to the detailed description which follows and the accompanying drawings.

DETAILED DESCRIPTION OF THE PREFERRED EMBODIMENT

Figure 1:
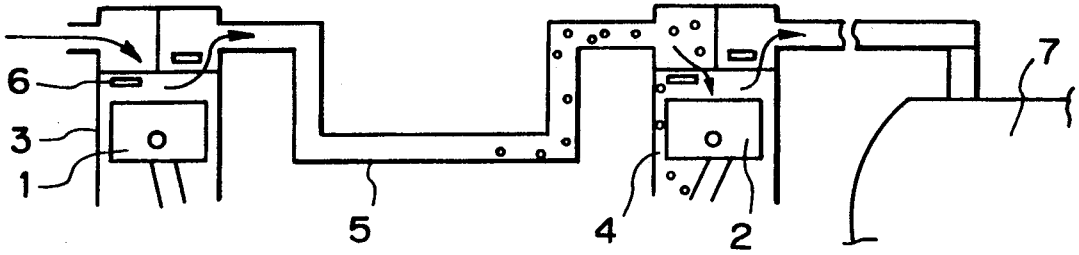
Fig. 1 PRIOR ART
FIG. 1 is a schematic view of a conventional multistage compressor.

Referring to FIGS. 3 to 8, a preferred embodiment of the invention will be explained.

Shown at 22 is a crankcase which defines in part a compressor body 21 and on which are mounted a lower pressure side compression part or first cylinder 23 and a higher pressure side compression part or second cylinder 24. The first and second cylinders 23, 24 receive therein respective reciprocating pistons (not shown) which are driven by means of a motor 28 which is, in turn, connected to a power source 27 through a switch 25 and an electromagnetic switch 26. The first and second cylinders 23, 24 have cylinder heads 29 and 30 mounted thereon, respectively, which are, in turn, provided with intake chambers 31, 32 and discharge chambers 33, 34, respectively.

The intake chamber 31 of the lower pressure side compression part is provided with a filter 35 mounted thereon, through which air is sucked into and compressed in the first cylinder 23. An intermediate conduit 36 communicates between the discharge chamber 33 of the lower pressure side compression part and the intake chamber 32 of the higher pressure side compression part, and a cooler 37 is disposed midway of the intermediate conduit 36 for cooling compressed air flowing therethrough from the first cylinder 23 to the second cylinder 24.

The cooler 37 is provided with a cooling body 38 which acts to cause heat to radiate from gas or to cool gas by utilizing refrigerant. The cooler 37 is further provided with a drain separation chamber 39 located downstream of the cooling body.

An obstacle plate 40 is mounted in the drain separation chamber 39 opposite the cooling body 38. At the bottom of the drain separation chamber 39 is formed a drain outlet port 41 at which is disposed a two-way electromagnetic valve 42. The valve 42 is open in an initial state.

The discharge chamber 34 of the higher pressure side compression part is connected to a tank 44 via a conduit 43. The tank 44 is provided with a pressure sensor 45 for detecting pressure in the tank 44. Shown at 46 is a controller connected to the pressure sensor 45, two-way electromagnetic valve 42, electromagnetic switch 26 and a display (not shown) for indicating data datected by means of the pressure sensor 45, and so on. The controller 46 is further connected to the power source 27 through the switch 25.

The controller 46 comprises a micro-computer, provided with first, second and third timers $T_1$, $T_2$ and $T_3$, respectively. The micro-computer carries out a premorized program on the basis of the data detected by the pressure sensor 45 and the data clocked by the timers to control the two-way electromagnetic valve 42 and the electromagnetic switch 26, thereby controlling the operation of the compressor.

Figure 4:
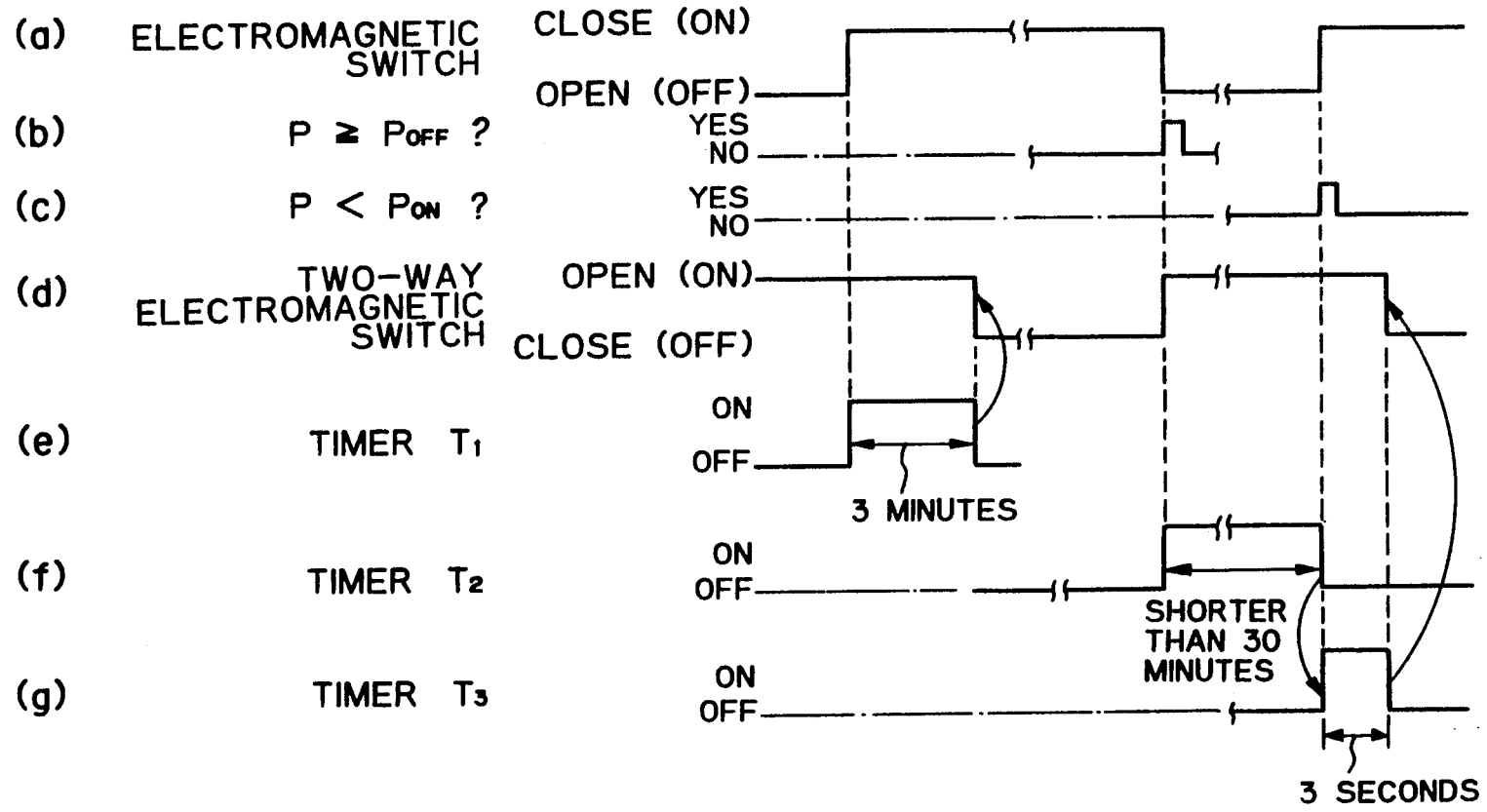
FIG. 4 is a timing chart of a controlled operation in the case where the compressor shown in FIG. 3 is controlled to re-start after a pause shorter than thirty minutes.
Figure 5:
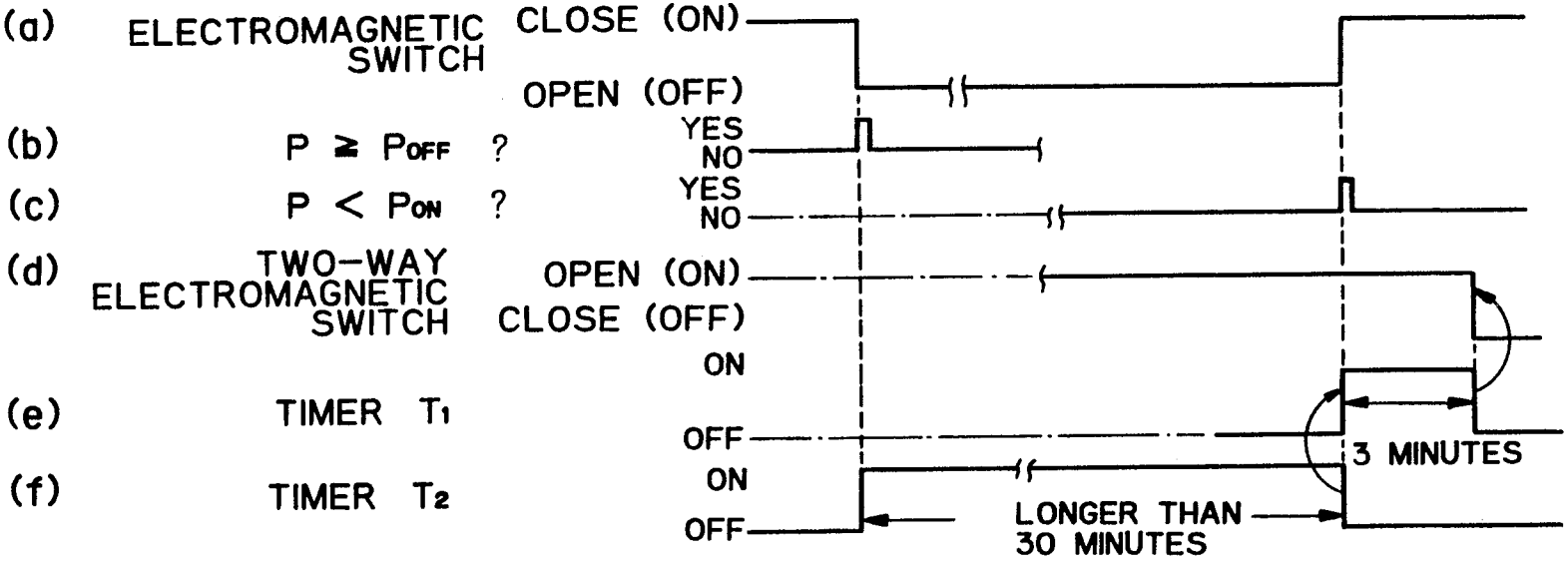
FIG. 5 is a timing chart of a controlled operation in the case where the compressor is controlled to re-start after a pause longer than thirty minutes.
Figure 6:
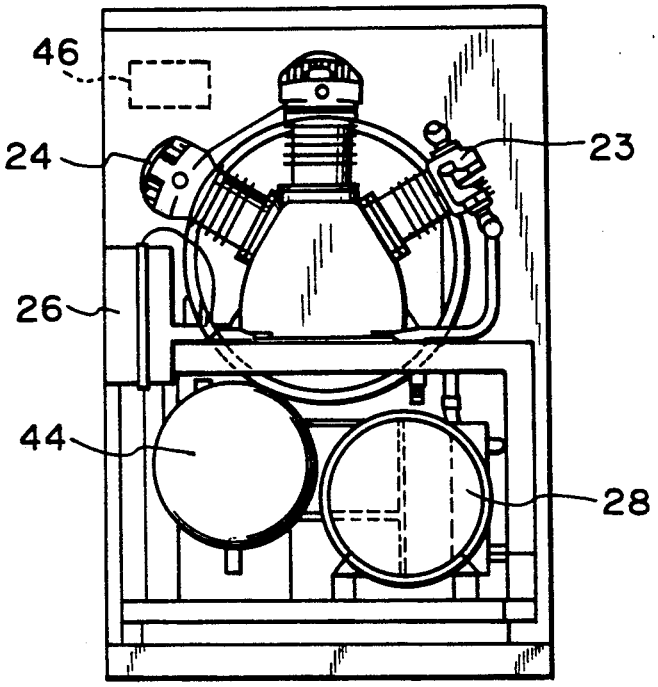
FIGS. 6 and 7 are front and side elevational views of the multistage compressor shown in FIG. 3, respectively.
Figure 7:
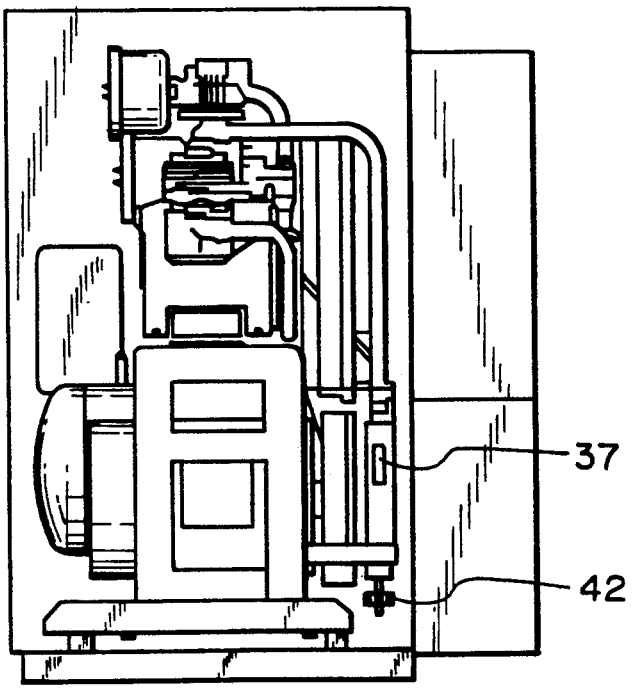

Referring to the timing charts shown in FIGS. 4 and 5, the control operation of the controller 46 will be explained.

When the switch 25 is turned on, the controller 46 starts its operation. First, the controller 46 turns the electromagnetic switch 26 on to start the motor in order to carry out the compressing operation. At the same time, the first timer $T_1$ is turned on. When the first timer $T_1$ clocks three minutes, the two-way electromagnetic valve 42 is closed. When the pressure P in the tank 44, which is detected by means of the pressure sensor 45, reaches a predetermined maximum pressure $P_{OFF}$, the electromagnetic switch 26 is opened or turned off to shut down the motor 28 to cease the compressing operation. At the same time, the two-way electromagnetic valve is opened or returned to the initial state, and the second timer $T_2$ is turned on.

As compressed air in the tank 44 is consumed, the pressure in the tank 44 lowers. When the pressure is lowered below a predetermined minimum pressure $P_{ON}$, compressing the operation re-starts. At that time, the following control is carried out.

The second timer $T_2$ starts to clock when the motor 28 is shut down ceasing the compressing operation, and stops clocking when the pressure in the tank 44 lowers below the minimum pressure $P_{ON}$ and the compressing operation is re-started. The controller 46 determines from the period of time clocked by the second timer $T_2$ whether or not the temperature of the intermediate conduit 36 has lowered substantially below the dew point of the compressed air from the first cylinder 23. When the period of time is longer than, for example, thirty minutes, the controller judges that the temperature of the intermediate conduit 36 has lowered substantially below the dew point, and closes or turns on the electromagnetic switch while turning the first timer $T_1$ on, as shown in FIG. 5. After that, the same control as that mentioned above is repeated. To the contrary, if the period of time clocked by the second timer $T_2$ is shorter than thirty minutes, the controller 46 judges that the temperature of the intermediate conduit still remains above the dew point, or has lowered only slightly below the dew point and closes or turns of the electromagnetic switch 26 while starting the third timer $T_3$. When the third timer $T_3$ has counted up to, for example, three seconds, the two-way electromagnetic valve 42 is closed. After that the same control as that mentioned above will be repeated. As will be explained hereinafter, when the compressor is re-started after a pause, the temperature of the intermediate conduit 36 starts to rise again and reaches a temperature above the dew point after a certain period of time lapses. In the present embodiment, it was expected that the time required for the temperature of the conduit 36 to rise above the dew point would be three seconds and so the timing under which the two-way electromagnetic valve 42 is closed was set at three seconds.

Figure 8:
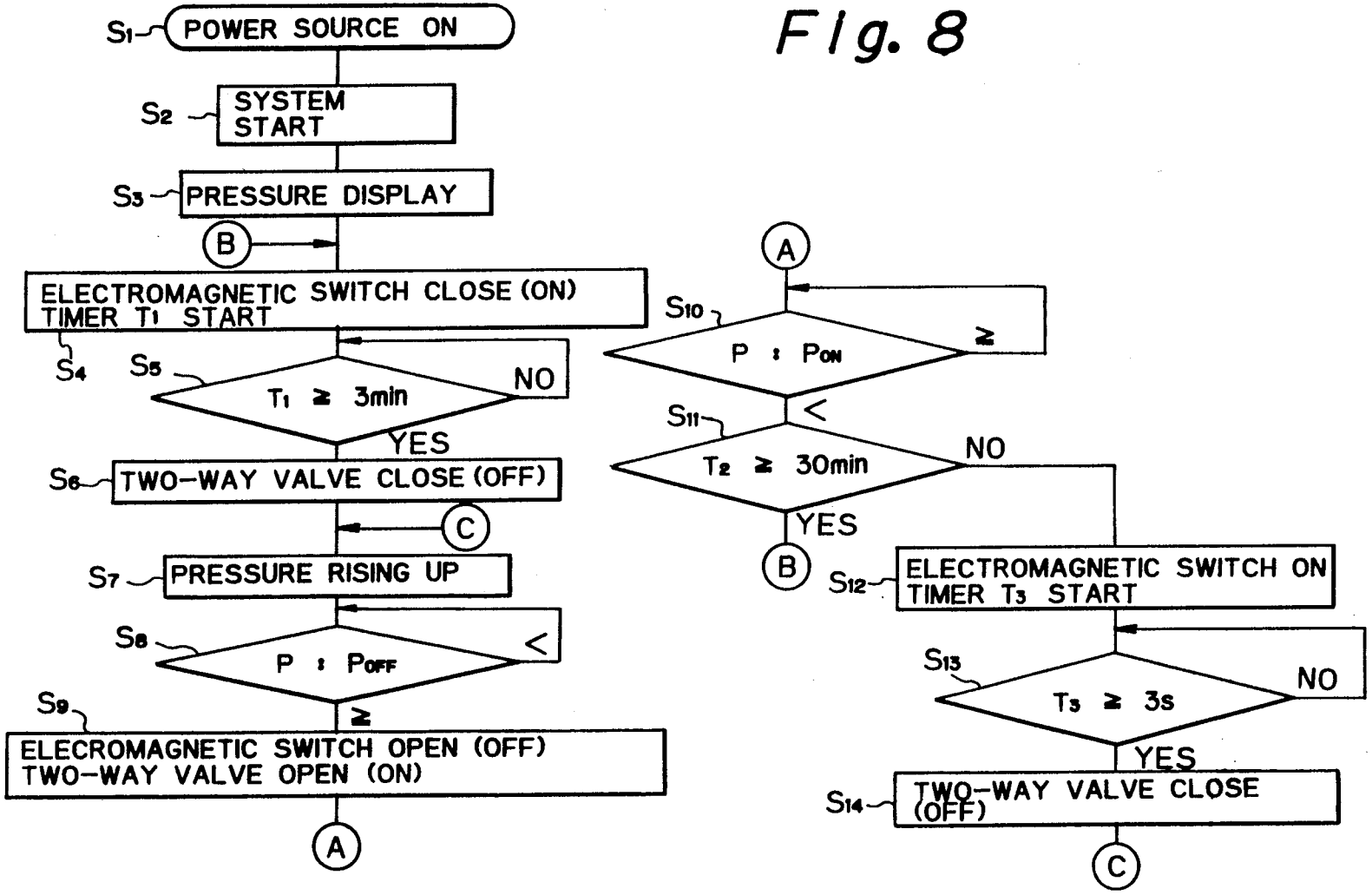
FIG. 8 is a flow chart of the controlled operation.

Referring to the flow chart of FIG. 8, the operation of the multistage compressor described above will be explained.

At step $S_1$, the switch 25 is turned on to switch the power source 27 on so that the system starts to operate (step $S_2$). The controller operates the display to indicate the pressure in the tank 44 detected the pressure sensor 45 (step $S_3$), and turns the electromagnetic switch on to start the motor 26 so that the compressor begins the compressing operation. At the same time, the first timer $T_1$ starts to count (step $S_4$). At step $S_5$, the controller determines whether or not the time clocked by the first timer $T_1$ is over three minutes.

During the operation through steps 4 and 5, the air compressed up to an intermediate pressure in the first cylinder 23 is cooled by means of the cooling body 38 so that the aqueous vapor contained in the compressed air condenses into waterdrops or drainage, which is discharged from the drain separation chamber 39 through the two-way electromagnetic valve 42, which is open. Thus, no drainage remains in the drain separation chamber, and dried compressed air at an intermediate pressure is transferred to the second cylinder 24. Meanwhile, the intermediate conduit 36 and cooler 37 are gradually warmed up as warmed compressed air is flowing through the intermediate conduit 36 and cooler 37. At this time, the two-way electromagnetic valve 42 being open allows a portion of the compressed air to leak therethrough so that pressure rising in the conduit 36 is restrained, thereby keeping the dew point at a lower level. As a result, the condition in the conduit changes so that, in a very short time, no more drainage is created.

When the first timer $T_1$ has counted up to three minutes, the controller judges the condition at step $S_5$ "YES" and closes or turns off the two-way electromagnetic valve 42 at step $S_6$, so that all of the compressed air in the first cylinder 23 is transferred to the second cylinder 24 without any leakage of compressed air through the two-way electromagnetic valve 42, thereby enabling the compressor to carry out an efficient compressing operation.

Figure 2:
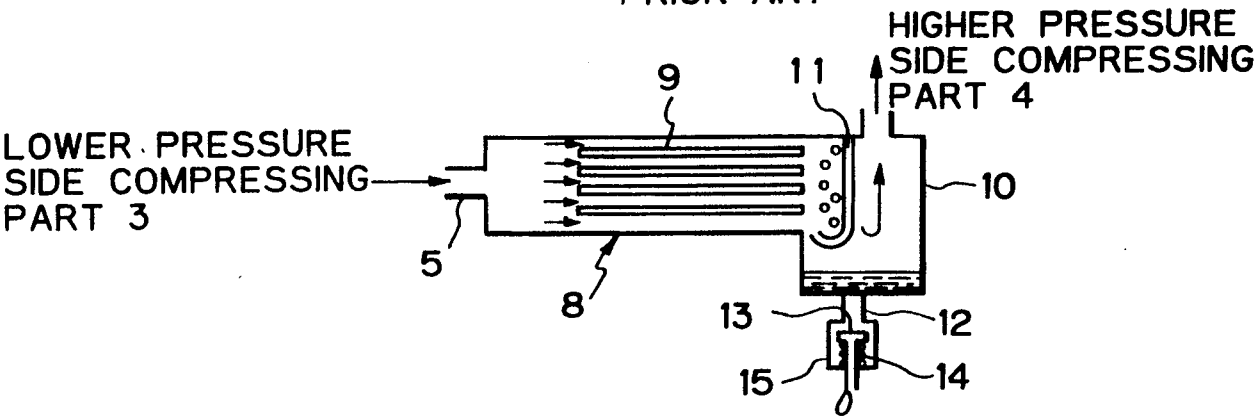
Fig. 2 PRIOR ART
FIG. 2 is a schematic view of a part of another conventional multistage compressor.
Figure 3:
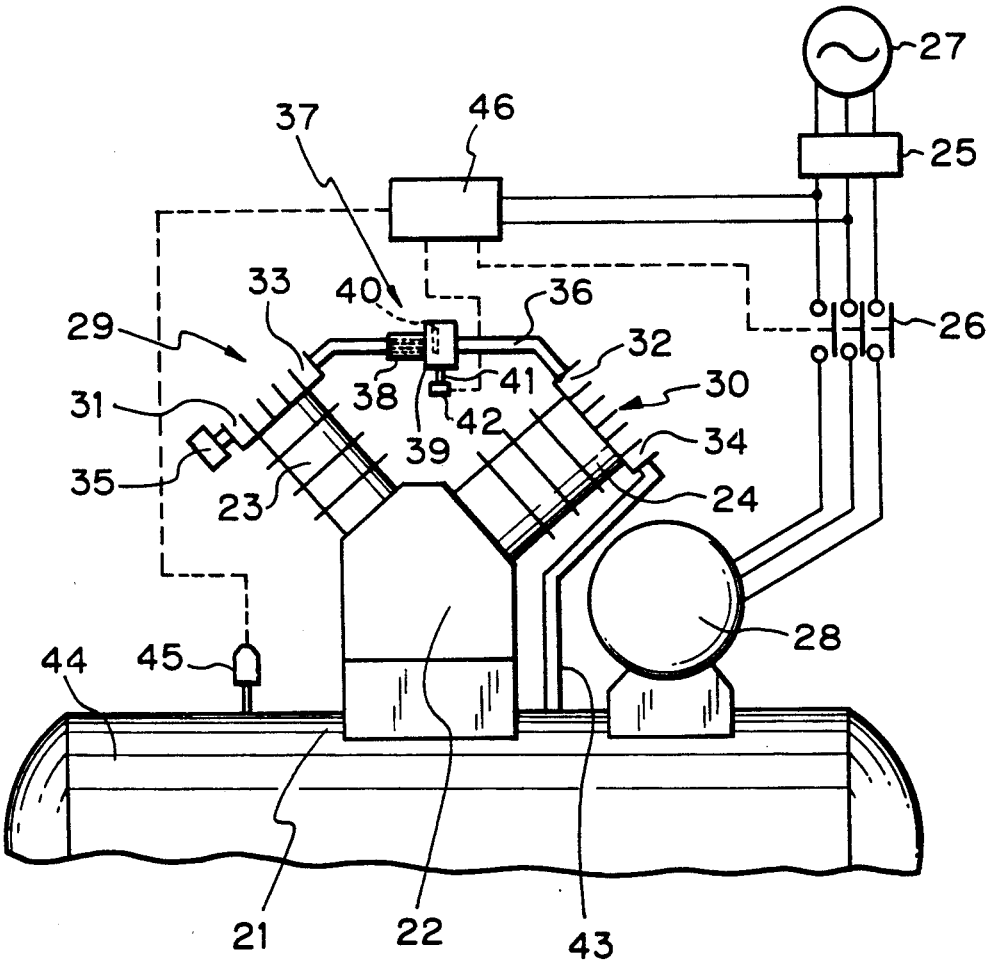
FIG. 3 is a schematic view of one embodiment of a multistage compressor according to the present invention.

As explained above, the two-way valve 42 of the present embodiment is kept open and allows drainage to be discharged for a longer period of time, as compared to the prior art explained in connection with FIG. 2 at an earlier stage of starting the compressor, in which more drainage can be created. Thus, emulsification of lubricant can reliably be prevented. Further, any large starting torque does not act on the motor 28 since the compressor carries out the compressing operation with the two-way valve opened for a relatively longer period of time. Accordingly, the motor 28 may be of a type which has a small starting torque.

As the compressing operation is carried out after the two-way valve 42 is closed, the pressure P in the tank 44 gradually rises (step $S_7$). At step $S_8$, the controller determines whether or not the pressure P in the tank 44 reaches the predetermined maximum pressure $P_{OFF}$. When the pressure P in the tank 44 reaches the maximum pressure $P_{OFF}$, the controller 46 opens the electromagnetic switch 26 to cease the compressing operation of the compressor. Simultaneously, the two-way electromagnetic valve 42 is opened and the second timer $T_2$ is turned on (Step $S_9$).

As compressed air in the tank 44 is consumed, the pressure in the tank 44 gradually lowers. The controller 46 determines whether or not the pressure in the tank 44 has become below the predetermined minimum pressure $P_{ON}$ at step $S_{10}$. When the pressure in the tank 44 lowers below $P_{ON}$, the controller determines whether or not the time clocked by means of the second timer $T_2$ is longer than thirty minutes at step $S_{11}$. If the answer is "YES", namely, the time is longer than thirty minutes, the flow of control returns to step $S_4$ and repeats the same controlled operation as that explained above.

If the answer is "NO", namely, the time is shorter than thirty minutes, the controller 44 turns the electromagnetic switch 26 on to start the motor 28 so that the compressing operation is carried out in both the first and second cylinders 23, 24, respectively. Simultaneously, the third timer $T_3$ is turned on (step $S_{12}$). At step $S_{13}$, a determination is made as to whether or not the time being clocked by means of the third timer $T_3$ exceeds three seconds. When three seconds have passed, the two-way electromagnetic valve 42 is closed (step $S_{14}$). Thus, the compressor continues the compressing operation without any leakage of compressed air through the two-way valve 42.

The controlled operation at stages $S_{12}$ to $S_{14}$ differs from that at stages $S_4$ to $S_6$ in that a shorter period of time (three seconds) is chosen for the timing for the two-way valve 42 to be closed, since only a very short period of time has passed after the termination of the compressing operation, and the temperature of the intermediate conduit 36 has not yet lowered substantially below the dew point of the compressed air from the first cylinder 23, and in that less drainage is created since the temperature of the intermediate conduit 36 rises over the dew point in a shorter time. However, similar to the operation at steps $S_4$ to $S_6$, drainage is discharged from the drain separation chamber 39 without any remaining therein so that dry compressed air is transferred to the second cylinder 24. Further, the opening of the two-way valve 42 inhibits a rise in pressure, so that the condition in the intermediate conduit changes in a short time to create no more drainage. It is to be noted that drainage is reliably discharged from the drain separation chamber 39 without leaving any remaining therein since the two-way valve 42 is kept open for three seconds after the re-starting of the compressor as opposed to the conventional compressor explained in connection with FIG. 2, in which the release valve 15 is closed immediately after the re-starting of the compressor, so that drainage created after the closing of the valve remains in the chamber 10.

After the control at step $S_{14}$ is carried out, the flow of control returns to step $S_7$ and the same control operating as that mentioned above is repeated.

An embodiment of a multistage compressor for compressing air has been explained. However, the present invention can, of course, apply to multistage compressors for compressing various kinds of gas other than air.

Although a two-stage compressor has been described above, the application of the present invention is not limited thereto.

Although the normally-open type electromagnetic valve is employed in the above embodiment, the valve does not necessarily have to be of a normally-open type. The valve may be controlled to be open for a period of time after the starting or re-starting of the compressor and then to be closed by means of any suitable controller.

What is claimed is:

1. A multistage compressor comprising:

a compressor body including a lower pressure side compression part, a higher pressure side compression part and a motor for actuating said lower pressure side and higher pressure side compression parts to compress gas;

an electromagnetic switch connected to said motor to energize and de-energize the motor;

a tank connected to said higher pressure side compression part so as to receive pressurized gas therefrom and store the pressurized gas;

a pressure sensor which senses the pressure in said tank;

an intermediate conduit placing said lower pressure side and higher pressure side compression parts in communication with one another;

cooler means disposed in said intermediate conduit for cooling gas flowing therethrough, said cooler means having a condensate discharge outlet;

an electromagnetic valve disposed at said condensate discharge outlet; and control means operatively connected to said pressure sensor and said electromagnetic switch for selectively energizing and de-energizing said motor by turning on and off said electromagnetic switch depending on signals from said pressure sensor, and said control means also operatively connected to said electromagnetic valve for opening said electromagnetic valve during a predetermined period of time after said electromagnetic switch is turned on to start or re-start the compressing operation of the compressor and for closing said electromagnetic valve upon the lapse of said predetermined period of time.

2. A multistage compressor according to claim 1, wherein said predetermined period of time is of a sufficient duration for the temperature of said intermediate conduit to rise above the dew point of compressed air in the intermediate conduit before said electromagnetic valve is closed.

3. A multistage compressor according to claim 1, wherein said control means includes a first timer which starts clocking when said electromagnetic switch is turned on such that the lapse of said predetermined period of time can be determined, said predetermined period of time being of such a duration that when the compressor is initially actuated, the temperature of said intermediate conduit rises to a temperature above the dew point of the compressed gas in the intermediate conduit before said electromagnetic valve is closed.

4. A multistage compressor according to claim 3, wherein said control means further includes a second timer which clocks the time from when the electromagnetic switch is turned off until it is subsequently turned on, and a third timer which starts clocking when said electromagnetic switch is turned on, said control means establishing the time period determined by the use of said first timer as said predetermined period of time when the time period clocked by the second timer is greater than a predetermined value and said control means establishing a time, which is clocked by said third timer and is less than that determined by the use of said first timer, as said predetermined period of time when the period of time clocked by said second timer is less than said predetermined value.

* * * * *